United States Patent [19]

Beck et al.

[11] 3,982,310

[45] Sept. 28, 1976

[54] YARN CRIMPING PROCESS AND APPARATUS

[75] Inventors: David Ernest Beck; Derek Walter Thom, both of Pontypool, England

[73] Assignee: Imperial Chemical Industries, London, England

[22] Filed: Dec. 5, 1974

[21] Appl. No.: 529,786

[30] Foreign Application Priority Data

Dec. 7, 1973 United Kingdom ..... 56774/73

[52] U.S. Cl. ..... 28/1.3; 28/1.4; 28/1.6

[51] Int. Cl.[2] ..... D02G 1/20; D02G 1/16; D02G 1/12

[58] Field of Search ..... 28/1.3, 1.6, 72.11, 28/72.14

[56] References Cited

UNITED STATES PATENTS

| | | | |
|---|---|---|---|
| 3,778,872 | 12/1973 | Newton | 28/1.6 |
| 3,802,038 | 4/1974 | Bauch et al. | 28/72.11 |
| 3,852,857 | 12/1974 | Ethridge | 28/1.3 |

*Primary Examiner*—Louis K. Rimrodt
*Attorney, Agent, or Firm*—Robert J. Blanke

[57] ABSTRACT

Process and apparatus for controlling a pad of yarn in the stuffing chamber of a steam jet crimper by means of mechanical restricting means and a counterpressure of cold fluid.

2 Claims, 1 Drawing Figure

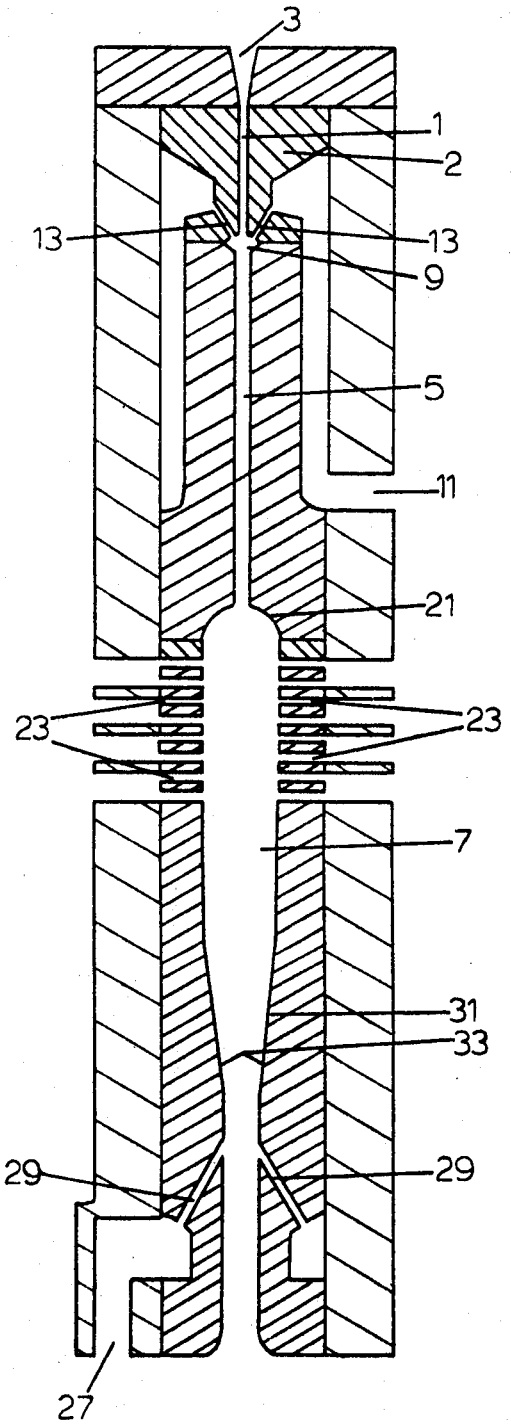
3
1
2
13
13
9
5
11
21
23
23
7
31
33
29
29
27

YARN CRIMPING PROCESS AND APPARATUS

The present invention relates to crimping process and apparatus in which a yarn is fed under the action of hot fluid directly into a stuffing chamber in which the yarn is impinged onto a pad of previously fed yarn and is compressed to impart crimp thereto whilst the pad is moved through the stuffing chamber, the crimped yarn subsequently being withdrawn from said stuffing chamber.

It has been found that, in order to obtain a yarn having satisfactory crimp properties, it is important to control the temperature and residence time of the yarn plug in the crimping chamber. One object of the present invention is to provide a crimping process and apparatus having means to effect such control.

According to the present invention, there is provided a continuous process for crimping yarn comprising the steps of forwarding a yarn under the influence of hot fluid, guiding the yarn being forwarded into a stuffing chamber, impinging the yarn against a pad of previously forwarded yarn present in said chamber, allowing hot fluid to escape radially from said chamber, controlling the location of the downstream end of said pad by a combination of a mechanical restricting means as defined hereinafter and a counterpressure of cold fluid, and continuously withdrawing the crimped yarn from said chamber.

Forwarding the yarn by hot fluid may be achieved by directing at least two streams, preferably four streams, of hot fluid symmetrically onto the yarn at an angle of between 20° and 40° inclusive to the axis of the yarn.

Also, according to the present invention, a yarn crimping apparatus comprises in sequence an inlet conduit for yarn, hot fluid forwarding means, a throat conduit for yarn and fluid, and a stuffing chamber for a pad of yarn having means to allow radial escape of hot fluid and wherein the crimping apparatus has control means comprising in combination a mechanical restricting means as defined hereinafter and means towards the yarn exit end of the crimping apparatus to inject a cold fluid into the stuffing chamber.

The mechanical restricting means is defined as means serving to physically act on the downstream end of the pad of yarn so as to impede movement of the downstream end of the pad towards the outlet of the chamber. Preferably the mechanical restricting means comprises a conical restricting outlet to the stuffing chamber and preferably said conical restricting outlet has an included angle of 15° to 90°.

The hot fluid may be a hot gas, for example air, or, preferably, steam under pressure.

It is preferred that the hot fluid forwarding means comprises at least two, preferably four, discrete channels inclined at an angle of between 20° and 40° inclusive to the axis of the yarn inlet conduit, the channels being disposed symmetrically with respect to the axis of said inlet conduit.

Preferably, the crimping apparatus has a diffuser chamber between the adjacent end portions of the yarn inlet conduit and the throat conduit into which the hot fluid is injected.

The stuffing chamber is of larger diameter than the throat conduit and may be provided with a conical- or hemispherical-shaped entry end to allow controlled expansion of the hot fluid. The stuffing chamber is provided with means, for example radially directed holes to allow radial escape of hot fluid.

Preferably, the means to inject a cold fluid into the stuffing chamber comprises at least two, preferably six, discrete passageways arranged symmetrically and disposed so as to direct the cold fluid into the stuffing chamber in a direction contrary to the direction of yarn travel. The cold fluid may, for example, be cold air. The cold fluid preferably escapes axially from the stuffing chamber with the crimped yarn.

The crimping process and apparatus of the present invention are suitable for crimping any synthetic filamentary material. They are particularly suitable for crimping polyamide filamentary material using steam as the hot fluid.

Subsequent to being withdrawn from the crimping apparatus and before being wound-up, the crimped yarn may be subjected to an intermingling treatment.

An embodiment of the yarn crimping apparatus according to the invention will now be described by way of example with reference to the accompanying drawing which is a sectional view of the apparatus.

The crimping apparatus has a yarn inlet conduit 1 formed in an insert 2, a yarn entrance 3, a throat conduit 5 for yarn and fluid and a cylindrical stuffing chamber 7. A diffuser chamber 9 is formed between the ends of the inlet conduit 1 and the throat conduit 5 by chamfering said ends.

The crimping apparatus is provided with an inlet 11 for hot fluid and four discrete channels 13 through which the hot fluid is injected into the diffuser chamber 9. The discrete channels 13 are formed by drilling the insert piece 2 and each channel 13 is inclined at an angle of 30° to the axis of the yarn inlet conduit 1. The four channels 13 are disposed symmetrically with respect to the axis of the yarn inlet conduit 1.

The stuffing chamber 7 has a hemispherical-shaped entry end 21 and is provided with radially directed holes 23 to allow escape of fluid.

The stuffing chamber 7 is provided with a conical restricting outlet 31 for the yarn, the conical restricting outlet 31 having an included angle 33 of 15° to 90°.

On the exit side of the conical restricting outlet 31, the crimping apparatus is provided with an inlet 27 for cold fluid and six symmetrical discrete passageways 29 to direct the cold fluid into the stuffing chamber 7 in a direction contrary to the direction of yarn travel.

In operation, yarn is entrained in the yarn inlet conduit 1. The yarn is intimately and uniformly contacted by hot fluid in the diffuser chamber 9. The yarn is forwarded by the hot fluid through the throat conduit 5 into the stuffing chamber 7. On entering the hemispherical entry end 21 of the stuffing chamber 7, the hot fluid expands and the filaments are separated. The separated filaments are impinged onto a pad of yarn which is continuously formed in the stuffing chamber 7. One end of the pad is located near the entry end 21, that is, above the fluid escape holes 23. The other end of the pad, i.e. the downstream end, is located in the conical restricting outlet 31 and is controlled by the conical restricting outlet 31 and the counterpressure of the cold fluid directed into the stuffing chamber through the passageways 29. The yarn is compressed in pad form as it is forced through the stuffing chamber 7. Hot fluid escapes through the radially directed holes 23. The downstream end of the pad is cooled by the cold air. The crimped yarn is withdrawn from the pad in a controlled manner.

The following examples illustrate but do not limit the present invention.

EXAMPLE 1

This Example illustrates the production of a crimped nylon 6.6 yarn which is particularly suitable for the manufacture of carpets.

A 7400 decitex 136 filament undrawn nylon 6.6 yarn was drawn at a draw ratio of 3.65 and a drawn yarn speed of 900 meters/min. After drawing, the yarn was fed directly at an overfeed of 20% to a crimping apparatus as shown in the accompanying drawing and having the following dimensions:

| | |
|---|---|
| Diameter of yarn inlet | 0.042" |
| Diameter of each of four steam supply channels | 0.022" |
| End diameter of chamfer on inlet conduit | 0.091" |
| End diameter of chamfer on throat conduit | 0.098" |
| Diameter of throat conduit | 0.062" |
| Diameter of stuffing chamber | 0.250" |
| Diameter of stuffing chamber outlet | 0.125" |
| Diameter of each of six cold air passageways | 0.020" |
| Included angle of conical outlet | 15° |

The crimping apparatus was operated under the following conditions:

| | |
|---|---|
| Pressure of supplied steam | 185 p.s.i.g. |
| Temperature of supplied steam | 350°C. |
| Pressure of supplied cold air | 15 p.s.i.g. |
| Withdrawal speed of crimped yarn | 720 meters/min. |

The crimped yarn was withdrawn from the crimping apparatus and was intermingled in an air jet to a hook drop length of 1.5 – 2.5 cm.

The crimped yarn so produced had a decitex of 2470 and a skein length (as hereinafter measured) of 16¾ inches.

The crimped yarn was used to prepare a tufted carpet at 10 oz./yd.$^2$.

EXAMPLE 2

This example illustrates the production of a crimped nylon 6.6 carpet yarn is which some of the filaments are partially fused together.

Example 1 was repeated using the same conditions except as follows:

| | |
|---|---|
| Withdrawal speed of crimped yarn | 693 meters/min. |
| Overfeed to crimping apparatus | 23% |

The crimped yarn was withdrawn from the crimping apparatus and was wound-up without being intermingled. The crimped yarn so produced had a decitex of 2500 and a skein length (as hereinafter measured) of 17⅜ inches. The crimped yarn contained some interfilament fusion such that the yarn had a pull apart load (as defined hereafter) of 358 g. and a filament cohesion (as defined hereinafter) of 6 – 10 g. The crimped yarn was particularly suitable for use in preparing a tufted carpet without the need for prior intermingling or twisting. The yarn exhibited better covering power in the carpet that the crimped yarn of Example 1.

COMPARATIVE EXAMPLE

Example 2 was repeated except that the stuffing chamber did not have a conical shaped outlet, i.e. that stuffing chamber was a uniform cylinder. The crimped yarn so produced had a skein length (as hereinafter defined) of 17⅞ inches. The crimped yarn contained no interfilament fusion and had a pull apart load which was too low to measure and a filament cohesion of zero. The crimped yarn was unsuitable for preparing a tufted carpet without prior intermingling or twisting. A carpet was prepared from the intermingled crimped yarn. The crimped yarn exhibited very inferior covering power in the carpet compared to the yarns of Examples 1 and 2.

The crimped yarns described in the above Examples were subjected to the following tests:

Skein Length

This was measured by the conventional method in which a skein of yarn was made by winding 36 wraps on a 1 meter circumference wrap wheel. The skein was suspended in water at 60°C. and the skein length measured under a tension of 60 g.

Pull Apart Load

A metal hook was clamped in each of the two jaws of an Instron (Regd. Trade Mark) tensile tester. A length of crimped yarn was separated into two halves at its mid-point. Each halve was placed in a hook and the hooks were then separated at a rate of 10 cms per minute. The maximum load reached during separation to 20 cms was recorded. Each crimped yarn was subjected to three tests, the pull apart load being the average of the three maximum loads.

Filament Cohesion

One filament was teased out for approximately 1 cm at each end of a 13 cm length of crimped yarn. The teased out filaments were clamped in the jaws of an Instron (Regd. Trade Mark) tensile tester and the jaws were then separated at a rate of 5 cm per minute. The maximum load reached during each cm of separation to a limit of 10 cm was recorded, the filament cohesion being the average of the maximum loads in each cm of separation tested on three 13 cm length samples.

We claim:

1. In a yarn crimping apparatus comprising in sequence an inlet conduit for yarn, hot fluid forwarding means, a throat conduit for yarn and fluid, and a stuffing chamber for a pad of yarn having means to allow radial escape of hot fluid, the improvement being comprised in that the crimping apparatus has control means comprising in combination a mechanical restricting means comprising a conical restricting outlet to the stuffing chamber and means toward the yarn exit end of the impinging apparatus to inject a cold fluid into the stuffing chamber.

2. An apparatus according to claim 1 wherein said conical restricting outlet has an included angle of 15° to 90°.

* * * * *